United States Patent [19]

Bishop

[11] Patent Number: 4,962,703

[45] Date of Patent: Oct. 16, 1990

[54] SELF SUPPLY AUTOMATIC INK STAMPING DEVICE

[76] Inventor: Alva J. Bishop, 3750 Greenbriar Dr., Zanesville, Ohio 43701

[21] Appl. No.: 380,007

[22] Filed: Jul. 14, 1989

[51] Int. Cl.[5] ..... B41K 1/38; B41J 27/04

[52] U.S. Cl. ..... 101/334; 101/41; 101/104

[58] Field of Search ..... 101/333, 334, 104, 105, 101/35, 41, 42

[56] References Cited

U.S. PATENT DOCUMENTS

| | | | |
|---|---|---|---|
| 3,804,016 | 4/1974 | Marozzi et al. | 101/333 |
| 4,004,511 | 1/1977 | de Groot | 101/334 |
| 4,718,341 | 1/1988 | Bishop | 101/334 |

*Primary Examiner*—Edgar S. Burr

*Assistant Examiner*—Chris Bennett

*Attorney, Agent, or Firm*—Francis T. Kremblas, Jr.

[57] ABSTRACT

An automatic contact ink stamping assembly characterized by repetitive movement of the die stamping surface between inverted positions defining an ink supply and a printing position. The apparatus is characterized by a stamping die assembly pivotally mounted to a carrier block reciprocally driven by a piston and cylinder assembly between the ink supply and printing position. The die assembly is provided with an upstanding ear having a cam surface which engages a rotatably mounted wheel in a manner to cause the die assembly to pivot 180 degrees responsive to the stroke of the piston and to align the die stamping surface in an accurate position perpendicular to the axis of said piston in both the ink supply and printing position.

6 Claims, 5 Drawing Sheets

SELF SUPPLY AUTOMATIC INK STAMPING DEVICE

BACKGROUND ART

The present invention relates generally to an automatic contact ink stamping apparatus for high volume ink marking applications. Many various types of contact ink stamping apparatus are available for industrial applications including relatively very expensive and sophisticated printers. In commercial or industrial applications, various parts, containers or substrates, for example, require marking with certain indicia in a clear, accurate manner.

A reasonable priced, and highly durable contact ink stamping device capable of high volume production and clear, strong imprints is disclosed in my prior U.S. Pat. No. 4,718,341. This apparatus provides rapid, repetitive ink stamping with the stamping die being re-supplied with ink after each stroke. The stamping die is inverted 180 degrees during each cycle between an ink supply and printing position riding along an arcuate slot forming a cam surface. Other prior art stamping devices use a similar cam slot to obtain this type of inverted action.

However, for industrial high volume applications, the accurate alignment of the stamping die surface required necessitates relatively close manufacturing tolerances which leads to greater expense and difficulty in the manufacturing process. This represents a limiting aspect for many applications which otherwise could advantageously use a less costly and yet reliable and durable automated contact ink stamping device in place of manual marking means.

BRIEF DESCRIPTION OF INVENTION

The present invention relates to an improved automatic contact ink stamping apparatus of the type which is self-inking on each stroke of cycle and is inverted between opposing 180 degree positions defining the ink supply and printing or stamping positions.

The apparatus of the present invention is characterized by a novel pivoting action imparted to the die stamp assembly which is dramatically more simple to manufacture and yet maintains the required tolerances to provide high volume production of clear, strong imprints.

The stamping die assembly is pivoted to a carrier block mounted on the end of a reciprocating piston rod and spring biased to urge it toward a perpendicular position to the axis of the piston rod when it is disposed in the extended printing position. A surface of the carrier block functions to stop the biased rotation of the stamping die assembly in the desired alignment.

The stamping die assembly carries an ear which includes and arcuate surface adapted to function as a cam follower which engages a cylindrical cam surface provided on a pivot wheel extended from a support base upon which the cylinder and piston is mounted.

Upon reciprocation of the piston, the cam follower surface of the ear engages the surface of the cam pivot wheel which causes the ear and the die stamp assembly to rotate 180 degrees to a precisely aligned inverted ink supply position engaging an ink pad assuring proper contact with the ink pad and a seal surrounding the ink pad reservoir.

The component parts comprising the cam pivot wheel and the ear provided with a cam following surface are relatively easy to manufacture and align in the assembled apparatus to assure close tolerances are maintained to accurately position the die stamping surface of the die stamp assembly.

Additionally, the cam pivot wheel and the cam follower ear are mounted for relatively easy removal and replacement when wear of the parts begins to interfere with proper alignment of the die stamping surface.

OBJECTS

Therefore it is a primary object of the present invention to provide a low cost, reliable, automatic contact ink stamping apparatus capable of high production and accurate performance.

It is another object of the present invention to provide an apparatus of the type described which is self-inking for each stamping cycle by providing a die stamping surface which pivots 180 degrees during its path of travel between an ink supply and printing positions to alternately accurately align the die stamping surface with an ink supply pad and the workpiece to be marked.

It is another object of the present invention to provide an apparatus of the type described wherein a unique cam pivot wheel and a cam following surface provided on the ink stamping die assembly cooperate to invert the die stamping surface during each cycle of driving piston.

It is another object of the present invention to provide an apparatus of the type described wherein the cam pivot wheel and the cam follower are removably mounted to permit easy replacement when deemed necessary to maintain accurate alignment of the die stamping surface in the ink supply and printing positions.

Figure 1:
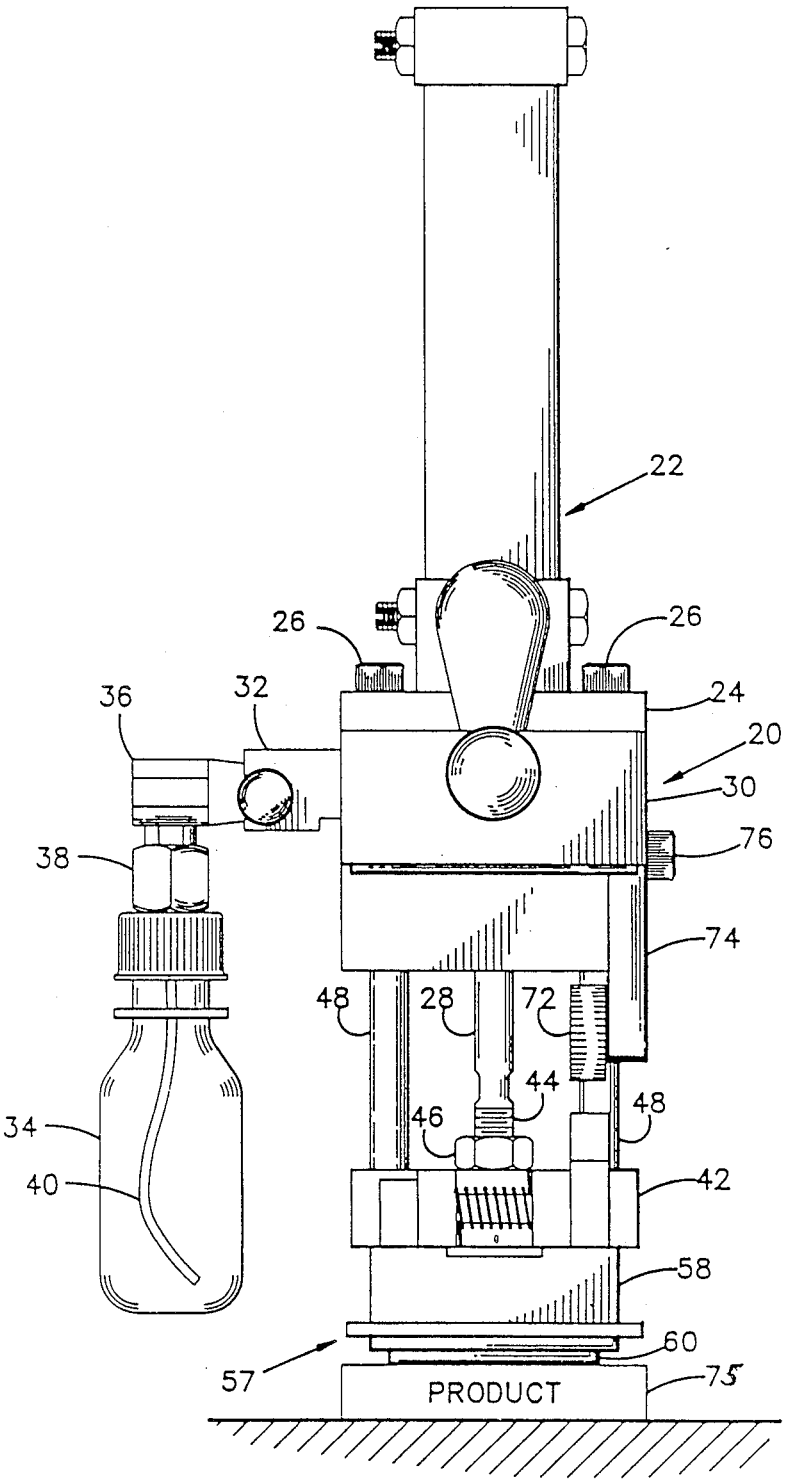
FIG. 1 is a front elevational view of the contact ink stamping apparatus constructed in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

Figure 2:
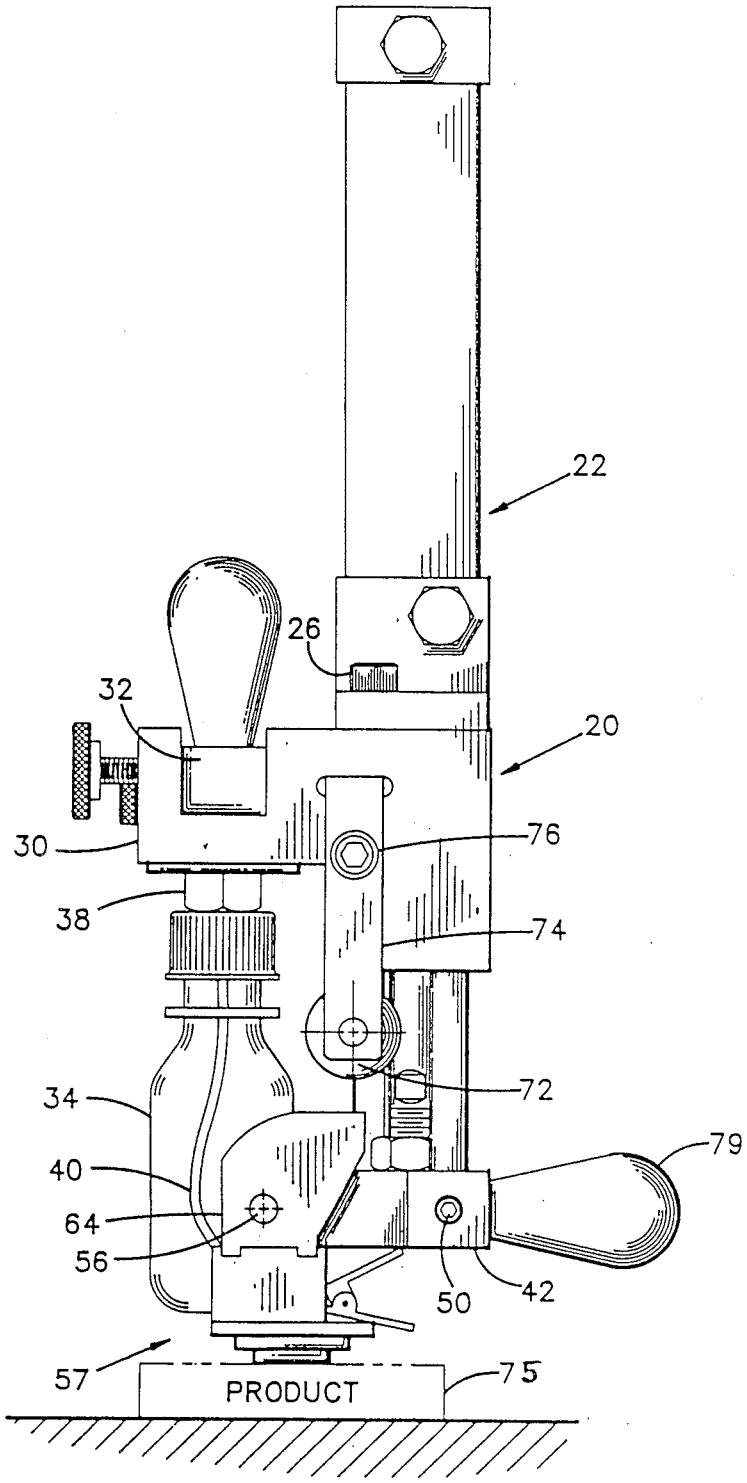
FIG. 2 is a side elevational view of the apparatus shown in FIG. 1.
Figure 3:
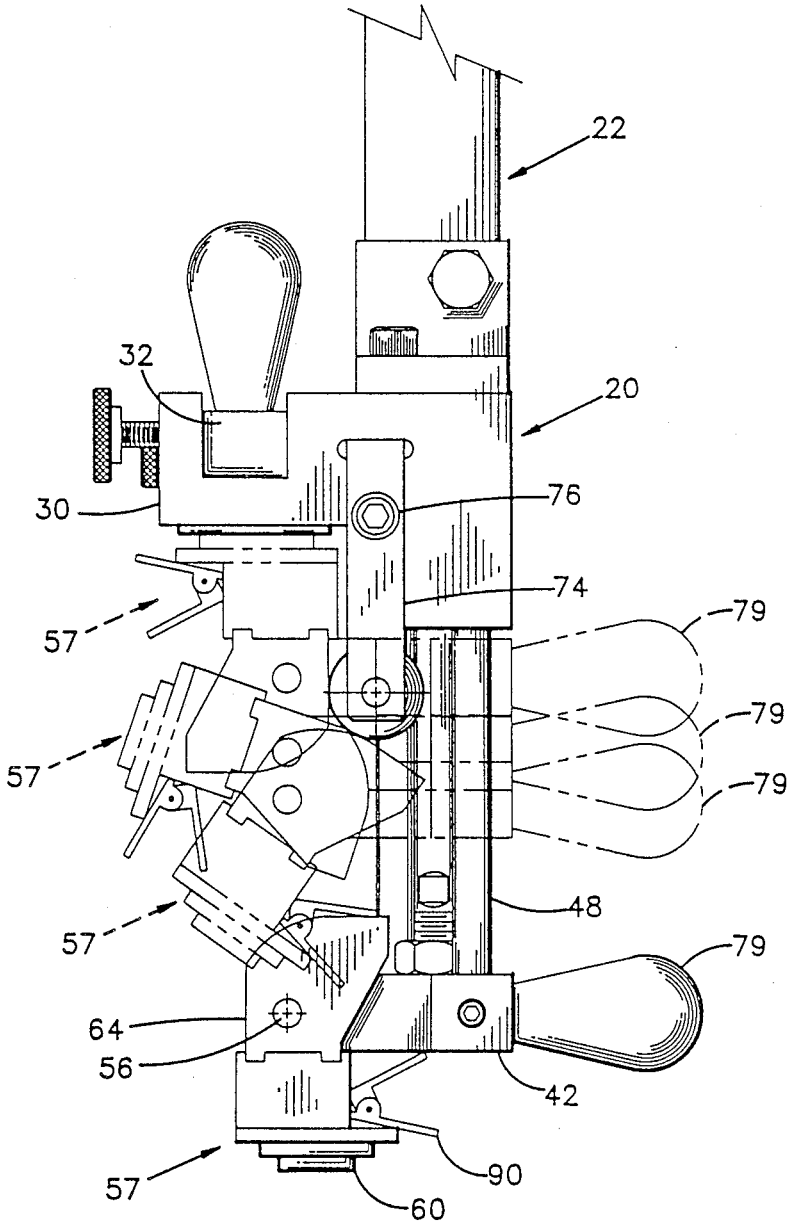
FIG. 3 is a side elevational view such as shown in FIG. 2 showing various positions of the ink stamping assembly as it moves to an ink supply from a printing position.

An automated contact stamping apparatus constructed in accordance with the present invention is shown in FIGS. 1–3 and includes a base, indicated generally at 20, which supports a conventional piston and cylinder assembly indicated generally at 22. Assembly 22 includes a mounting base 24 which is fixed by conventional fasteners 26. A piston rod 28 associated with assembly 22 is extended through a drilled hole in base 20 for reciprocation between extended and retracted positions.

Preferably base 20 is provided with an ink reservoir holder 30 extending outwardly from base 20 and adapted to receive a removably mounted ink supply reservoir 32 provided with an ink pad in accordance with the description contained in my co-pending application Ser. No. 331,549 filed on 3/31/89. However, other ink supply reservoir constructions such as described in my U.S. Pat. No. 4,718,341 could be used without departing from the spirit of the present invention.

As described in my co-pending application, Ser. No. 331,549, an ink supply bottle 34 is removably mounted via a suitable conventional elbow fitting 36 via a conventional male threaded hollow fitting 38 to permit a wick 40 to be extended from ink bottle 34 through both fittings 36 and 38 and into ink reservoir 32 to communicate ink to an ink pad mounted therein.

A carrier block 42 is fixed to the threaded end 44 of piston rod 28 and secured by a conventional nut 46 in an adjustable manner to permit some degree of flexibility to the position of carrier block 42 relative to the end of piston rod 28.

A pair of guide rods 48 are fixed to carrier block 42 and are slideably extended in parallel relationship to piston rod 28 through suitable bores provided in base 20 to assure accurate linear movement of block 42 responsive to the stroke of piston rod 28. Preferably, guide rods 48 are fixed to block 42 via a set screw, such as shown at 50 to make assembly and dis-assembly relatively easy.

Figure 4:
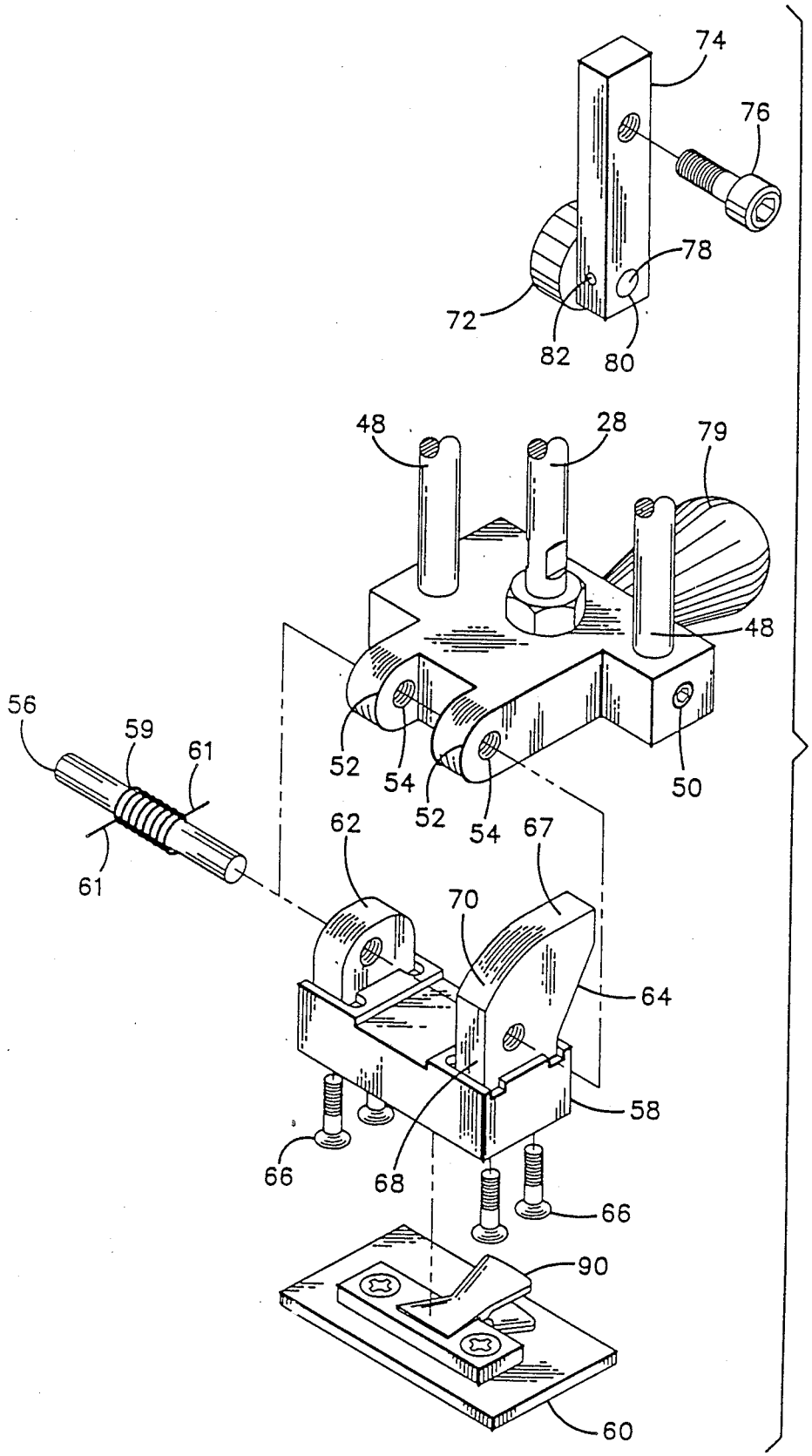
FIG. 4 is a partial exploded perspective view of certain components included in the apparatus shown in the preceding Figures illustrating the relationship between the ink stamping assembly, the carrier block and the cam wheel forming a portion of the present invention.

As best seen in FIG. 4, carrier block 42 also includes a pair of forwardly extending, spaced lugs 52, each provided with bores 54 horizontally aligned with one another and adapted to receive a shaft 56.

A pivot block 58 is provided which forms part of the die stamp assembly indicated generally at 57 which includes a die stamping surface 60 carrying indicia to be printed. If desired, the die stamping surface 60 may be removably mounted to the pivot block by using a die stamp mounting plate which is releasably fixed to block 58 by means of a spring clip 90 in a conventional manner. However, a permanent die stamping surface or other forms of a removably mounted stamping surface may be employed without departing from the spirit of the present invention.

Pivot block 58 includes a pair of upstanding ears 62 and 64 which are rotatably mounted to the outer ends of shaft 56. Ears 62 and 64 are preferably removably mounted in a secure position by four screws, such as 66, for ease of assembly and for dis-assembly for replacement purposes. Ear 64 is larger than ear 62 and includes a cam following surface comprised of the upper and frontal surfaces which are configured to engage a cam wheel as described in detail later herein to cause pivot block 58 to rotate 180 degrees in a precisely defined manner. The upper surface 67 and frontal surface 68 are generally perpendicular to one another and modified and joined by an arcuate or curved surface portion 70.

A cam wheel 72 is rotatably mounted to a depending arm 74 fixed within a recess provided in base 20 by a threaded fastener 76. Cam wheel 72 is rotatably mounted on a shaft or pivot pin 78 mounted through a bore 80 and fixed by a threaded fastener 82. Preferably wheel 72 is held in position by a conventional snap ring or the like to facilitate assembly and replacement as may be necessary.

Pivot block 58 is spring biased to pivot in a counterclockwise direction by coil spring 59 surrounding shaft 56 and provided with biasing legs 61. Therefore pivot block 58 and die stamping assembly 57 as a whole are biased to return to pivot about shaft 56 in a counterclockwise direction as shown in FIGS. 2 and 3, toward a position disposing die stamping surface 60 perpendicular to the axis of piston rod 28 and parallel to the surface to be marked. This is defined as the printing position.

The lower surface of carrier block 42 and the upper surface of pivot block 58 can be accurately dimensioned to form a stop to limit the degree of pivoting of pivot block 58 to disposed the die stamping surface in an accurately aligned position relative to the defined printing position to which block 58 is biasedly returned via the action of spring 59.

A handle or knob 79 is optionally provided and may be fixed to carrier block 42 in any conventional manner to manually manipulate piston rod 28.

As best seen in FIG. 2, die stamping assembly 57 is shown in full line in the printing position relative to a workpiece, such as 75, and piston rod 28 is in its fully extended position at the end of its stroke. The movement of die stamping assembly 57 is illustrated in ghost lines in FIG. 3 as piston rod 28 moves through its return stroke. As piston rod 28 retracts, the inner upper portion of surface 67 on ear 64 is aligned to engage cam wheel 72 which causes ear 64 and pivot block 58 to rotate clockwise against the spring bias of spring 59 about the axis of shaft 56. As piston rod 28 continues toward the retracted position, ear 64 continues to rotate as follower surface 67 engages wheel 72, however the point of engagement between wheel 72 and ear 64 continually moves along surface 67 toward the curved portion 70 the frontal surface 68.

The rotational engagement between cam wheel 72 and ear 64 continues until the portion of frontal cam surface 68 which is parallel to the axis of piston rod 28 is reached. At this point, the die stamping surface 60 has been inverted 180 degrees and is held in this alignment as it moves into proper parallel engagement with the ink pad provided in ink supply reservoir 32. The pivot block 58 and associated die stamping surface 60 is held in this position by the engagement between cam wheel 72 and frontal surface portion 68 against the bias of spring 59.

Upon reversal of the stroke of piston rod 28, the reverse action occurs as the cam following surfaces on ear 64 reverse their sequence until the stroke of piston 28 carries ear 64 out of engagement with cam wheel 72. Then pivot block 58 and die stamping surface 60 are returned to their original printing position by the bias force of spring 59.

As shown in FIG. 3, it should be noted that the relatively precise alignment of die stamping surface 60 in both the lowered printing position and the raised ink supply position is very important in a high volume industrial application.

In the printing position, the die stamping surface should be parallel to the surface being marked to provide a clear strong and complete mark. However, in the ink supply position as discussed in detail in my prior U.S. Pat. No. 4,718,341 and in my co-ending application Ser. No. 331,549 maintaining a good sealed relationship with ink supply reservoir seal, such as at 78, and assuring full contact with the ink pad is also very important to achieve a repetitive clear mark or print.

In the present invention, the required alignment is obtained very satisfactorily employing relatively simple manufactured components which possess substantial durability and are relatively easy to assembly or replace when necessary due to excessive wear.

In this regard it should be noted that since cam wheel 72 is free to turn or rotate, the friction between wheel 72 and the cam following surfaces 68, 67 and 70 is reduced to provide longer wear characteristics.

Further, the inverting action provided by the engagement of cam Wheel 72 and the cam follower surfaces provided on ear 64 permit the piston stroke to be significantly shorter to obtain the same 180 degree rotation compared to the cam slot such as disclosed in my prior U.S. Pat. No. 4,718,341. This permits a much smaller or miniaturized automatic contact stamping device to be manufactured much easier for practical commercial uses than prior art types. Additionally, the shorter stroke length permitted employing the construction of the present invention allows higher cycle rate to be achieved. However, just as important, the stroke length can be easily increased, if desired for a given application, to obtain a long stroke without the necessity of increasing a long and expensive to manufacture cam surface, such as required in my prior U.S. Pat. No. 4,718,341.

Figure 5:
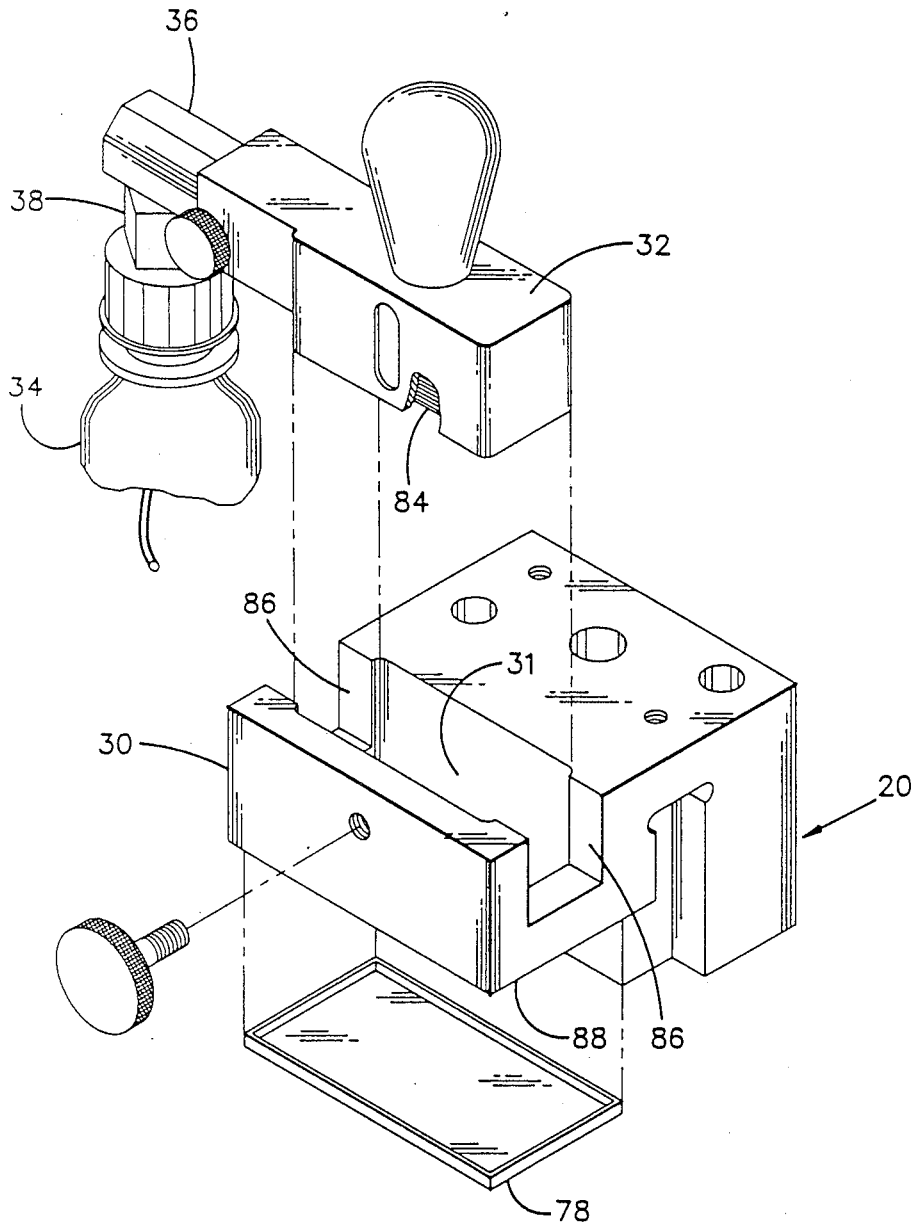
FIG. 5 is an exploded perspective view of the supporting base means and associated ink supply remainder of the apparatus shown in FIG. 1.

With respect to the ink supply reservoir 32 and holder 30, reference is made to FIG. 5 illustrating the preferred version described in detail in my co-pending application Ser. No. 331,549 earlier referred to herein. In view of the description in that application which is incorporated by reference herein, only a brief description of the ink supply means will be made herein.

As shown in exploded relationship in FIG. 5, base 20 includes a forwardly extending ink reservoir holder portion 30 which includes a recess 31 having a top and bottom opening configured to receive an ink supply reservoir 32 in a removably mounted manner. Ink supply reservoir 32 is provided with a bottom facing recess for removably mounting a felt type ink pad 84. Ink supply bottle 34 is mounted via the earlier described fittings 36 and 38. Ink reservoir holder 30 is provided with cut out portions 86 in both side walls 88 merely to provide for mounting bottle 34 on either side for convenience in a field application where it may be desirably because of space limitation.

Seal 78 made of conventional flexible material is provided around the periphery of the bottom opening in ink reservoir holder 30 which is designed to sealingly engage I0 the outer periphery of the die stamping surface 60. The proper alignment of the die stamping surface 60 is a sealed relationship with seal 78 is essential to prevent drying out of the ink pad 84 during period of non-use.

The removably mounted ink supply reservoir 32 is particularly desirable for applications which require frequent changes in the color of ink used.

In view of the foregoing description, it should be readily appreciated that the automatic contact ink stamping apparatus provides a significant improvement compared to those of this type regarding its ease of manufacture while using relatively simple and inexpensive components to provide high quality performance at much lower costs.

A particular advantage of the present invention is that the length of the piston stroke 28 relative to the position of the workpiece, which may be dictated by the setting of the assembly line in which the contact printer is used, may be easily varied within a relatively wide range merely employing a longer piston rod and guide rods. Since the pivoting or inverting action is confined to a relatively short length of the piston stroke and is involved in correctly positioning pivot block 58 near the ink supply position, a more compact or an extended printing position is possible at very low cost. The proper printing position is independent of any extended cam action and relies upon the bias of spring 59 and the limiting stop surfaces provided on pivot block 58 and carrier block 42.

Additionally it should be noted that the contact printing apparatus of the present invention would work equally as well in applications wherein the degree of inversion required is greater or less than 180 degrees. For example, due to spacial requirements or the like, the ink reservoir holder 30 and ink reservoir 32 could be disposed at a 30 degree angle downwardly from the horizontal position shown in FIG. 1. Then the die stamping assembly need only travel through an arc of approximately 150 degrees to be properly aligned in the ink supply position with the die stamping surface engaging the ink reservoir seal and ink pad in a parallel relationship. An angle greater than about 30 degrees upwardly or downwardly from the horizontal introduces significant problems in obtaining appropriate parallel alignment and engagement between the ink pad and die stamping surface in the ink supply position.

While certain preferred embodiments of the present invention have been disclosed in detail, it is to be understood that various modifications may be adopted without departing from the spirit of the invention or scope of the following claims.

I claim:

1. An automatic contact ink stamping apparatus for repetitive printing of selected indicia on selected workpiece comprising, in combination; (a) a base supporting a piston and cylinder assembly for reciprocal movement of a piston rod between extended and retracted positions; (b) an ink supply reservoir mounted on said base and including an exposed ink pad; (c) a carrier block fixed to the outer end of said piston rod for movement therewith; d) a die stamp assembly including a die stamping surface, said assembly being pivotally mounted to said carrier block about an axis perpendicular to the axis of said piston rod and spring biased to urge said die stamping surface toward a printing position facing the direction of said extended position of said piston rod in a plane perpendicular to the axis of said piston rod; (e) an ear provided on said die stamping assembly and pivotal therewith and including a selected cam following surface; (f) a cam pivot wheel provided with an axis parallel to the axis of rotation of said die stamp assembly and extending from said base in a position along the path of travel of said piston rod for engagement with said cam following surface on said ear of said stamping assembly responsive to movement of said piston rod between extended and retracted positions to cause said stamping assembly to rotate between said printing position and an ink supply position defined with said die stamping surface rotated into substantial parallel facing engagement with said ink pad.

2. The apparatus defined in claim 1 including a pair of spaced guide rods slideably mounted to said base means in parallel relationship to said piston rod and wherein each of said guide rods are fixed at one end to said carrier block.

3. The apparatus defined in claim 1 wherein said ear is fixed to said die stamp assembly and is pivotally mounted to said carrier block to rotate between 180 degree positions responsive to the extended and retracted positions of said piston rod upon engagement with said pivot wheel.

4. The apparatus defined in claim 1 wherein said pivot wheel is rotatably mounted.

5. An automatic contact ink stamping apparatus for repetitive printing of predetermined indicia on selected workpieces comprising, in combination, a piston and cylinder assembly mounted on a base means and including a piston rod having a selected reciprocal stroke extending between a retracted and an extended position; an ink supply reservoir mounted on said base means and including an ink supply pad disposed in a plane at an angle between about 60 to 120 degrees relative to the axis of said piston; a carrier block mounted to the end of said piston rod and responsive to the stroke of said piston for movement between extended and retracted positions; a pivot block including a stamping die surface, said pivot block pivotally mounted to said carrier block and spring biased to urge said pivot block to a normal position with said stamping die surface disposed facing outwardly relative to the direction of said extended stroke of said piston rod; said pivot block including projecting ears, at least one of said ears forming a cam following surface; a pivot wheel mounted to and extending away from said base means in the direction of said stroke of said piston rod and provided with a peripheral cam surface engagable with said cam following surface on said ear of said pivot block in response to the stroke of said piston rod to cause said pivot block to rotate between a retracted ink supply position defined with said die stamping surface in parallel engaging relationship to said ink supply pad and an extended printing position defined with said die stamping surface engaging a workpiece to be stamped.

6. In an automatic contact ink stamping apparatus provided with a die stamping surface mounted for movement between an ink supply position and a printing position spaced along an arc at least about 150 degrees from one another, the combination of a base; a driven piston supported on said base between an extended and retracted stroke; a carrier block fixed to said piston; an ink stamping assembly pivotally mounted to said carrier block and including a die stamping surface; a circular cam wheel fixed to said base and having an axis perpendicular to the axis of said piston, said wheel disposed between said printing position and said ink supply position along the path of travel of said piston; a projecting ear on said ink stamping assembly provided with a selective cam following surface engagable with a portion of the circumference of said cam wheel responsive to the stroke of said piston to cause said ink stamping assembly to pivot about at least 150 degrees in one direction upon the retracted stroke of said piston and to pivot in the opposite direction upon the extended stroke of said piston; said ink stamping assembly being spring biased to return to a normal position with said die stamping surface disposed in a plane perpendicular to the axis of said piston upon dis-engagement from said cam wheel.

* * * * *